US005848620A

United States Patent [19]

Yu

[11] Patent Number: 5,848,620

[45] Date of Patent: Dec. 15, 1998

[54] RETAINER PULLER

[76] Inventor: Chin-Yung Yu, No. 5, Cheng-Te 3 Lane., Sec. 2, Ta-Ching Street, N. Dist., Taichung, Taiwan

[21] Appl. No.: 787,944

[22] Filed: Jan. 23, 1997

[51] Int. Cl.[6] ..... B21F 9/00

[52] U.S. Cl. ..... 140/123.5

[58] Field of Search ..... 81/9.3; 140/93.2, 140/93.4, 123.5, 123.6, 153; 254/216

[56] References Cited

U.S. PATENT DOCUMENTS

| | | | |
|---|---|---|---|
| 1,777,762 | 10/1930 | Nelson | 140/123.5 |
| 2,020,175 | 11/1935 | Durr | 140/123.5 |
| 2,195,763 | 4/1940 | Wright | 140/123.5 |
| 2,623,424 | 12/1952 | Ackerman | 140/123.5 |
| 4,646,591 | 3/1987 | Jansen | 81/9.3 |

*Primary Examiner*—Lowell A. Larson
*Attorney, Agent, or Firm*—Bacon & Thomas

[57] ABSTRACT

A retainer puller including a head with two clamp halves commonly having an opening at their front ends and a handle at their rear ends, and a bolt. The clamp halves are each provided with a hole. The bolt includes a polygonal head and a rod provided with an axial slot of a determined depth across the free end thereof. The rod of the bolt is rotatably secured through the respective holes of the clamp halves. In use, the free end of a retainer is inserted into the opening of the clamp halves and then into the slot of the bolt. By turning the bolt with a wrench, the free end of the retainer may be wound on the rod to reduce the internal diameter of the retainer and thus tighten the retainer on the objects onto which it is fastened.

1 Claim, 5 Drawing Sheets

RETAINER PULLER

BACKGROUND OF THE INVENTION (a). Field of the Invention

The present invention relates generally to a hand tool, and more particularly to a retainer puller for tightening a retainer on the objects onto which it is fastened.

(b). Description of the Prior Art

As a general rule, when a soft tubular element is fitted onto a hard object, a retainer is required to fastened the joint. With reference to FIG. 1, which shows a transmission shaft, the ends of the shaft are respectively provided with a bearing bowl accommodating a plurality of balls. In order to prevent dust or other particles from entering the bearing bowl to affect the smooth operation of the transmission shaft, a resilient protective sleeve is fitted onto the bearing bowl at either end of the shaft. And a retainer is used to fasten the joint between the sleeve and the bearing bowl.

The retainer is essentially a strip of metal having a loop at one end. The loop extends vertically to form two press plates so that the free end of the retainer may extend into the loop to form a ring. After the retainer is fitted onto the joint of the objects onto which it is fastened, the press plates are pressed to hold the retainer in position, and the superfluous part of the free end is severed. A major problem is that it is very difficult to apply forces at the free end of the retainer, particularly when the retainer has been wound somewhat tightly on the objects. If the retainers are not firmly tightened, they may slip off the joints and affect smooth operation.

SUMMARY OF THE INVENTION

A primary object of the present invention is to provide a retainer puller for tightening retainers, which is simple and easy to operate and may assure effective tightening of the retainers.

In order to achieve the above-mentioned object, the retainer puller according to the present invention essentially comprises a head having an opening at a front end and a handle at a rear end. The head is provided with a couple of holes at corresponding positions. A bolt has one end pivotally disposed in the holes of the head. That end of the bolt is provided with a slot. In use, the free end of the retainer is passed into the opening and then into the slot so that the free end of the retainer may be wound on the bolt by turning the bolt with a wrench. The internal diameter of the retainer may thus be reduced so that the retainer may firmly hold the objects onto which it is fastened.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
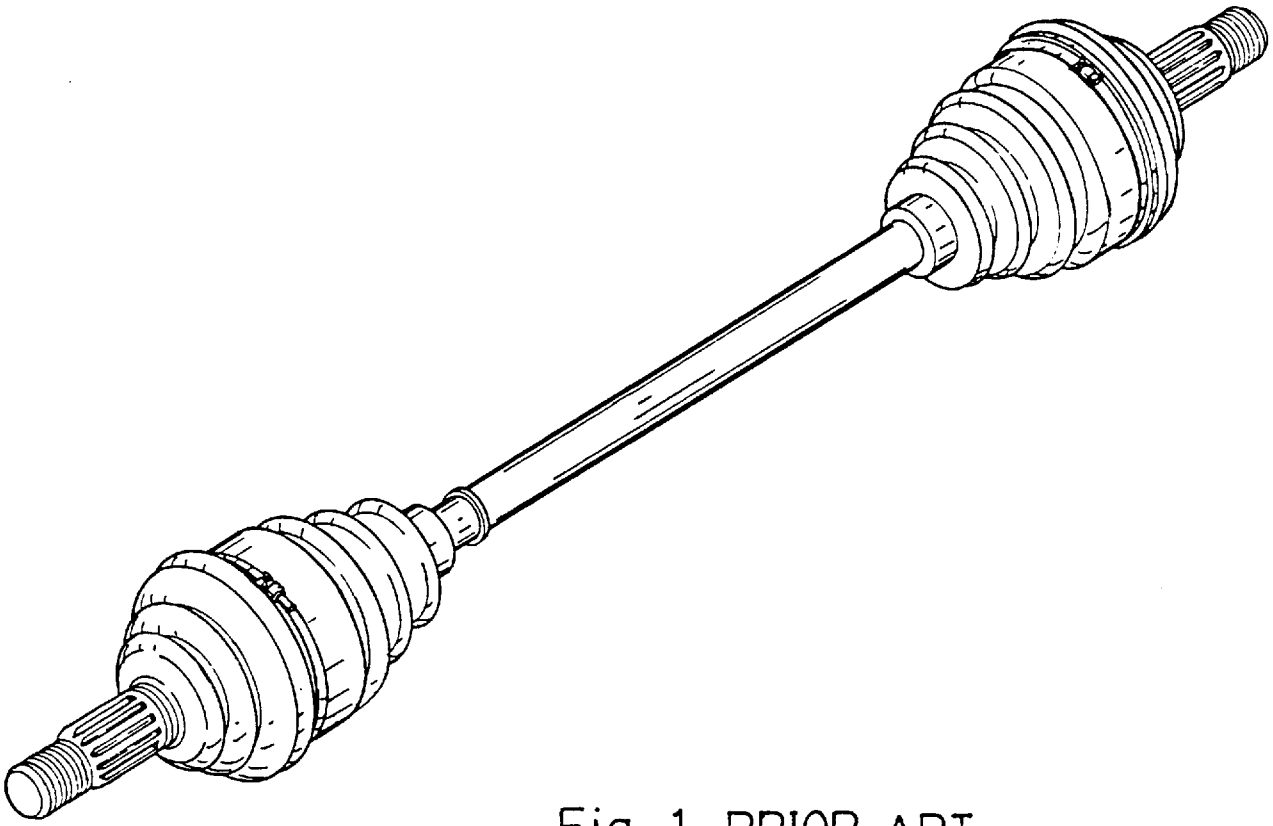
Fig. 1 PRIOR ART
FIG. 1 is a perspective view illustrating a car transmission shaft having retainers fastened thereonto.
Figure 2:
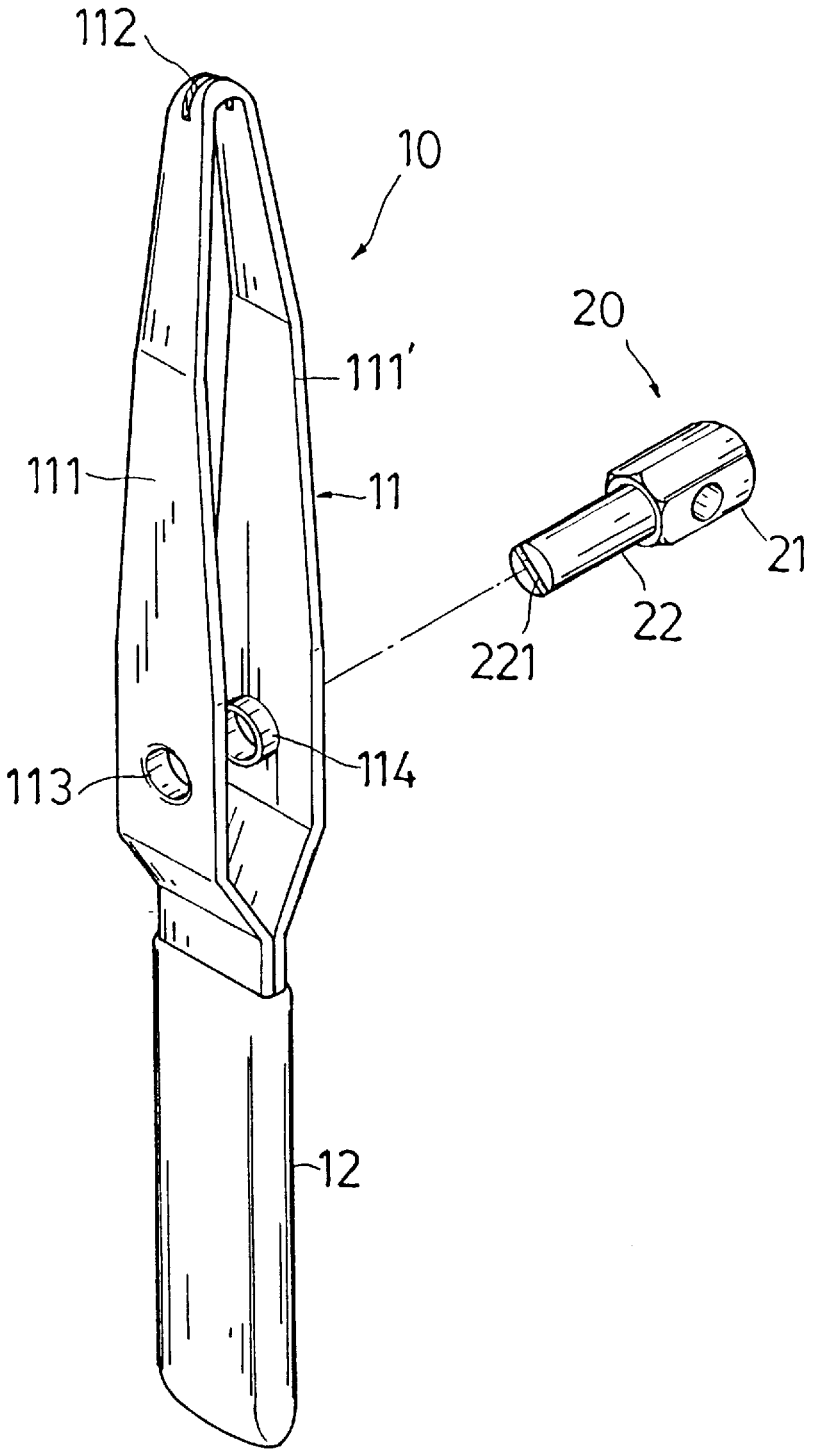
FIG. 2 is an exploded perspective view of the retainer puller of the present invention.
Figure 3:
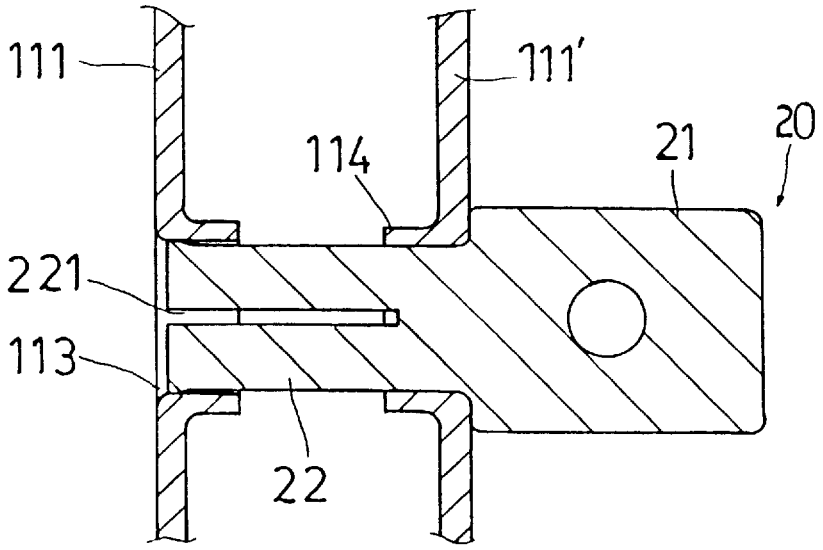
FIG. 3 is a sectional view of a bolt of the present invention.

With reference to FIGS. 2 and 3, the present invention is directed to a retainer puller 10 which essentially comprises a head 11. The head 11 is a single curved portion of a metal plate bent to form two equal clamp halves, 111 and 111'. An opening 112 is formed at the single curved portion formed by the front ends of the clamp halves 111 and 111'. The rear ends of the clamp halves 111 and 111' are held together by sleeving same into a handle 12 for gripping purposes. A suitable distance is maintained between the clamp halves 111 and 111'. The clamp halves 111 and 111' are further provided with holes 113 and 114 respectively at corresponding positions such that the hole 113 has a diameter slightly larger than that of the hole 114.

The present invention further comprises a bolt 20 including a polygonal head 21 and a rod 22 connected to the polygonal head 21. The rod 22 is provided with an axial slot 221 of a determined depth cut across the middle of its free end. The rod 22 of the bolt 20 is passed into the hole 114 and then through the hole 113. Then the periphery of the rod 22 is punched so that its free end has an expanded external diameter substantially equivalent to the internal diameter of the hole 113. In this way, the bolt 20 will not slip out of the hole 114 and is retained to the head 21 for rotational movement with respect thereto.

Figure 4:
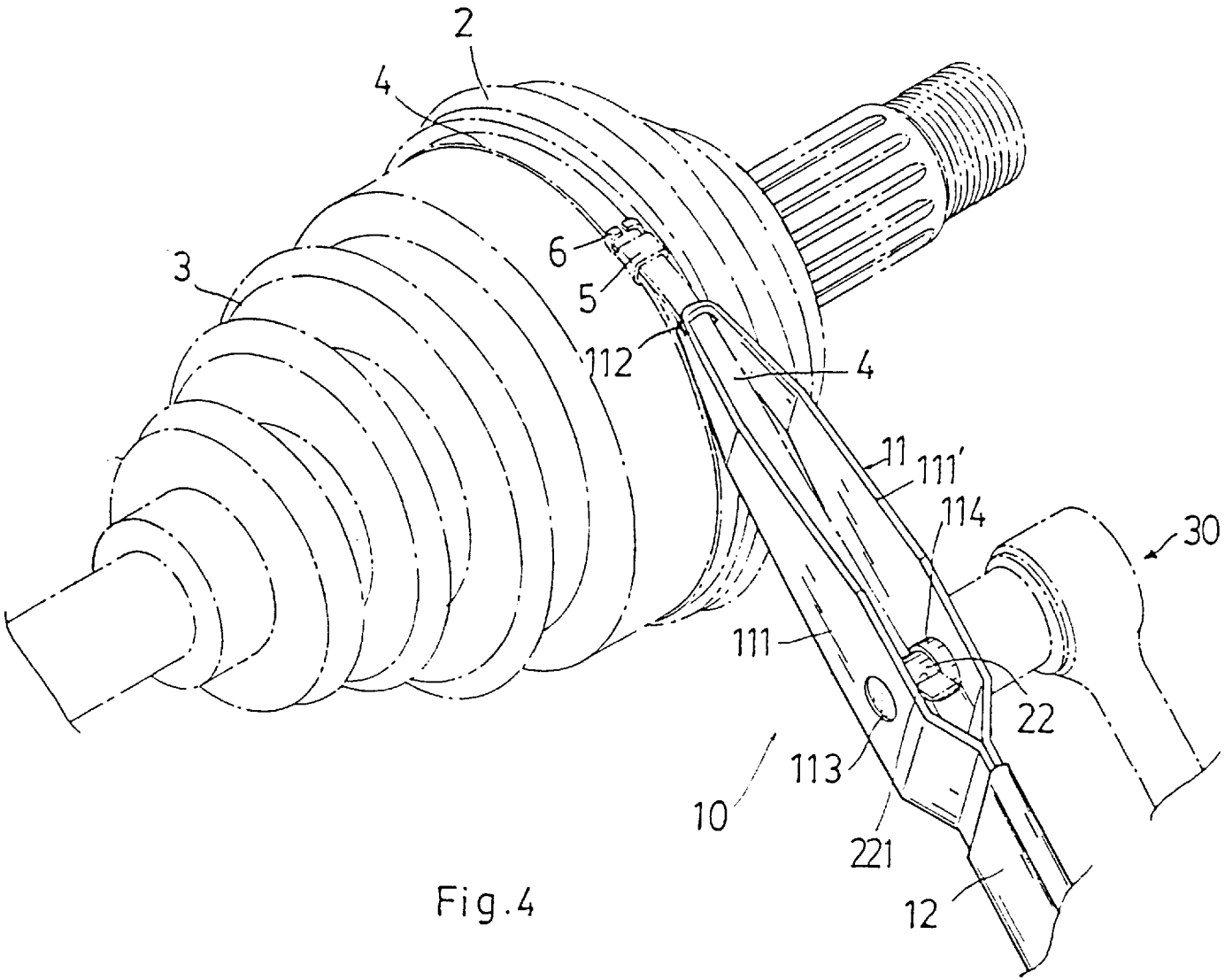
FIG. 4 is a schematic view illustrating use of the present invention.

With reference to FIG. 4, a retainer 4 for use in the wheel transmission shaft of cars is shown. The retainer 4 is fitted at the joint between a bearing bowl 2 and an elastic protective sleeve 3. In the present invention, the free end of the retainer 4 is passed through a loop 5 thereof into the opening 112 of the head of the retainer puller 10 and then into the slot 221 of the bolt 20. A combination wrench 30 having a polygonal box may then be fitted onto the polygonal head 21 of the bolt 20 so that by turning the wrench 30 the free end of the retainer 4 may be wound on the bolt 20. In this way, the internal diameter of the retainer 4 may be reduced so that the retainer 4 may tightly clamp onto the elastic protective sleeve 3 which in turn presses tightly against the bearing bowl 2.

After the retainer 4 has been pulled tightly in position, a press plate 6 thereof may be pressed to secure the end of the retainer 4. The superfluous part of the free end of the retainer 4 may be severed, and the severed part will remain in the retainer puller 10. By turning the wrench 30 in a reverse direction so that the superfluous part of the free end of the retainer 4 wound on the bolt 20 may be released and drawn outwardly.

Figure 6:
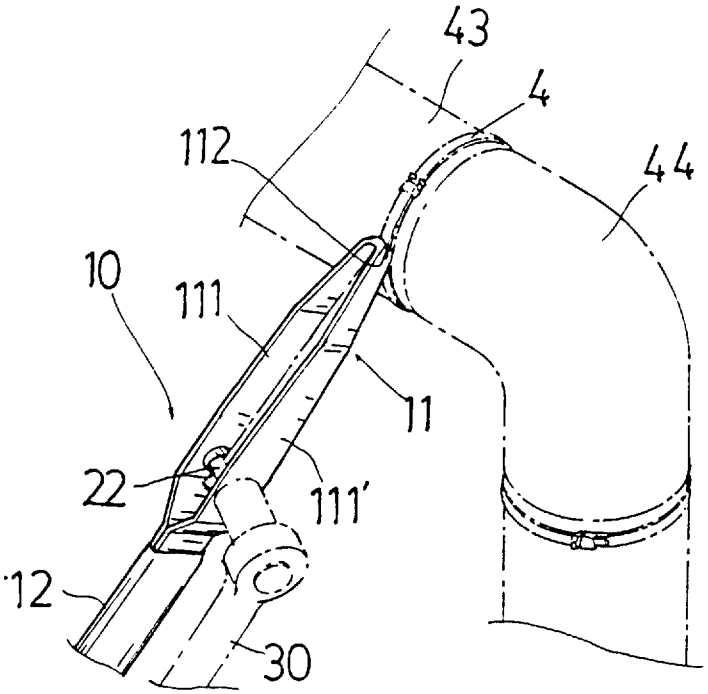
FIG. 6 is a further schematic view illustrating use of the present invention.
Figure 5:
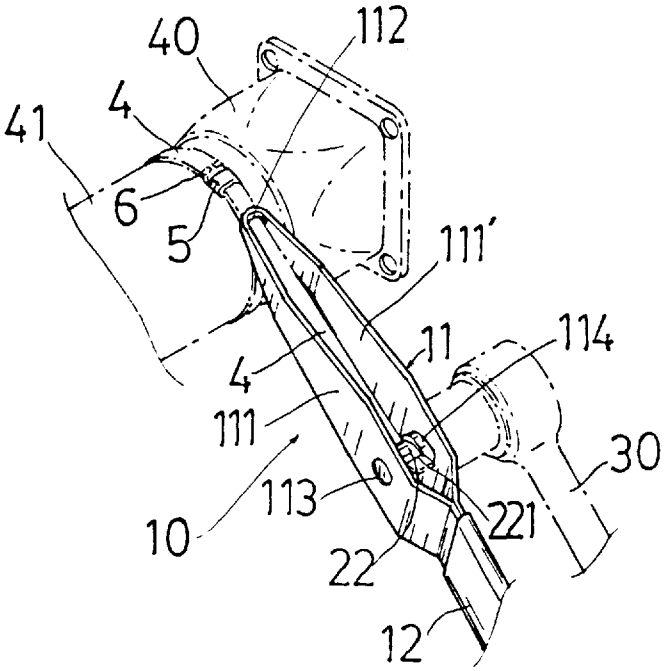
FIG. 5 is another schematic view illustrating use of the present invention.

With reference to FIGS. 5 and 6, where a soft sleeve or a hose is sleeved on a hard or rigid object and use of a retainer is necessary, the present invention may be utilized to tighten the retainer. Referring to FIG. 5, an air outlet 40 of a car air conditioner is joined to a air supply tube 41. The joint is fastened with a retainer 4. By using the retainer puller 10 of the present invention, the retainer 4 may be tightened on the joint. Referring to FIG. 6, a hose 43 is fitted onto a hard tube or pipe 44, and a retainer 4 is used to secure the joint. Likewise, the present invention may be used to tighten the retainer 4 on the joint.

From the foregoing, it can be seen that the retainer puller of the present invention provides an easy and simple way to tighten the retainer on a joint to a greatest extent so that the joint may be firmly fastened, thus eliminating the problem with the prior art.

Although the present invention has been illustrated and described with reference to the preferred embodiment thereof, it should be understood that it is in no way limited to the details of such embodiment but is capable of numerous modifications within the scope of the appended claims.

I claim:

1. A retainer puller for tightening a retainer used to secure a joint between a soft tubular element and a hard element, the puller comprising:

a) a head formed from a single flat metal plate bent to define a single curved portion forming a front end and a pair of spaced apart clamp halves extending from the front end and terminating in a pair of rear ends, an opening formed in the front end for receiving an end of a retainer therethrough, a hole formed in each clamp half, the holes being disposed in axial alignment with each other, and one hole being of a larger diameter than the other hole;

b) a handle for gripping by a user, the rear ends of the clamp halves being sleeved into the handle for securing the rear ends together;

c) a bolt having a head for engagement by a wrench, a rod extending from the head and terminating in a free end, an axial slot formed across the middle of the free end of the rod and extending inwardly therefrom, the rod being disposed through the holes of the clamp halves, with the free end of the rod being positioned at the larger diameter hole and punched expanded to prevent the free end of the rod from passing through the smaller diameter hole and retain the bolt to the clamp halves for rotational movement with respect thereto; and d) whereby the front end of the head may be positioned at the joint and the end of the retainer be received through the opening thereof and secured within the axial slot of the bolt so that rotation of the bolt by the wrench causes the retainer to be wound around the bolt and tightened around the joint.

* * * * *